US005083603A

United States Patent [19]

Heurtault

[11] Patent Number: 5,083,603

[45] Date of Patent: Jan. 28, 1992

[54] METHOD FOR THE CONTINUOUS CASTING OF THIN METAL PRODUCTS

[75] Inventor: Serge Heurtault, Metz, France

[73] Assignee: Institut de Recherches de la Siderurgie Francaise (IRSID), Puteaux, France

[21] Appl. No.: 582,780

[22] Filed: Sep. 14, 1990

Related U.S. Application Data

[63] Continuation-in-part of Ser. No. 376,106, Jul. 6, 1989, abandoned.

[30] Foreign Application Priority Data

Jul. 6, 1988 [FR] France ..... 8809275

[51] Int. Cl.[5] ..... B22D 11/00

[52] U.S. Cl. ..... 164/463; 164/480

[58] Field of Search ..... 164/423, 427–429, 164/479–480, 463

[56] References Cited

U.S. PATENT DOCUMENTS 4,212,344 7/1980 Uedaira et al. ..... 164/479
4,450,891 5/1984 Belden et al. ..... 164/479
4,648,439 3/1987 Willim ..... 164/428
4,771,819 9/1988 Toyama et al. ..... 164/428
4,842,042 6/1989 Bartlett et al. ..... 164/479

FOREIGN PATENT DOCUMENTS 59-13551 1/1984 Japan ..... 164/427

*Primary Examiner*—Richard K. Seidel
*Assistant Examiner*—Edward A. Brown
*Attorney, Agent, or Firm*—Pollock, Vande Sande & Priddy

[57] ABSTRACT

In continuously casting thin metal products such as sheets or strips, molten metal is introduced into the gap between a rotating cooled main cylinder and a counter-rotating roller spaced from the cylinder to form a gap corresponding to the thickness of the desired product. The metal, in cooling, forms solidifying skins on the respective rollers. The peripheral speed of the roller exceeds that of the cylinder by 2 to 20%. The resulting product is substantially free of the surface defects characteristic of prior art processes.

2 Claims, 1 Drawing Sheet

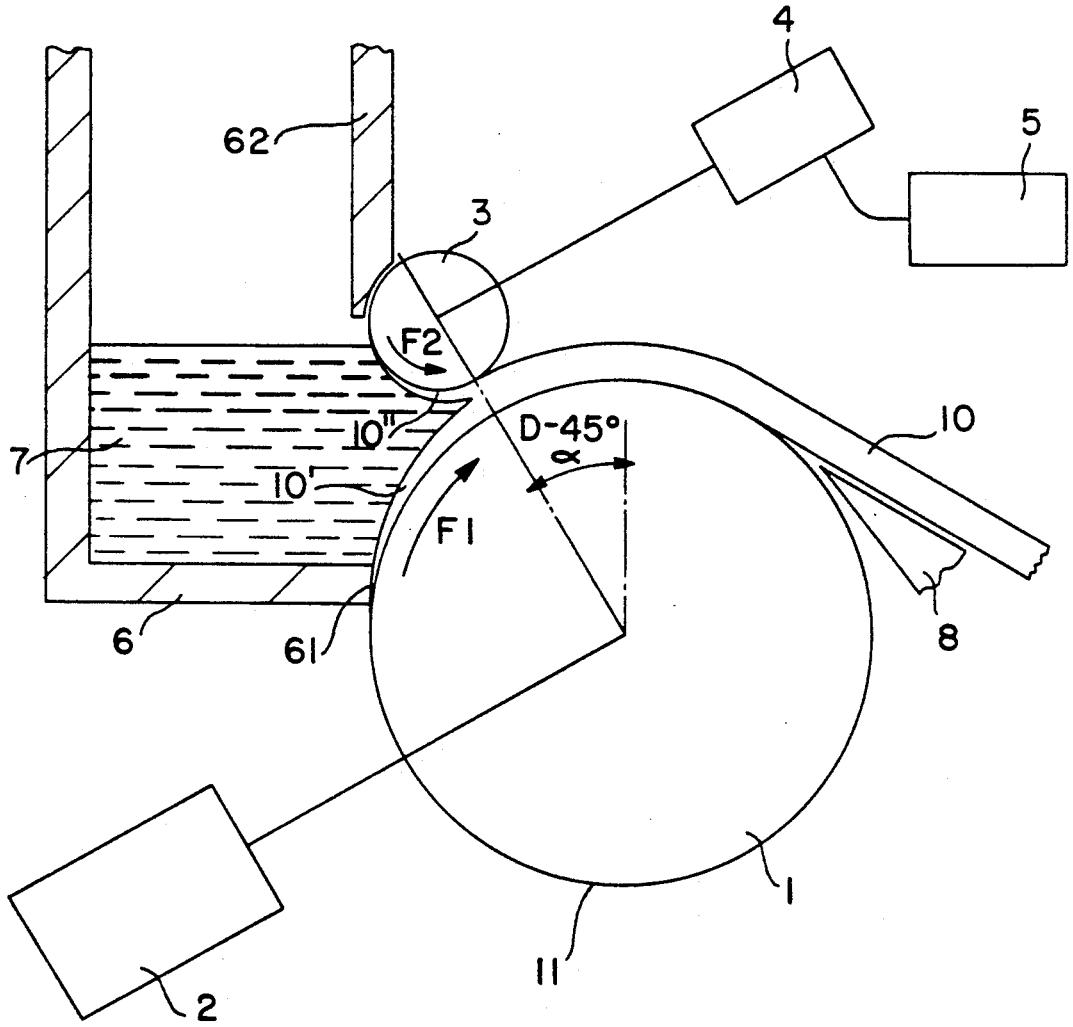
4
5
62
3
F2
10
D-45°
α
10"
7
10'
F1
6
61
8
1
11
2

METHOD FOR THE CONTINUOUS CASTING OF THIN METAL PRODUCTS

This application is a continuation-in-part, of application Ser. No. 07/376,106, filed July 6, 1989 now abandoned.

FIELD OF THE INVENTION

The present invention relates to the direct production of metal strips or sheets from molten metal, and more particularly to the production of strips or sheets of slight or very slight thickness, especially of steel, by the technique known as continuous casting onto a cylinder.

This known technique consists in pouring the molten metal onto the cooled side wall of a rotationally driven cylinder, the metal solidifying on contact with said wall and the resulting strip being held in contact with the wall over a part of the circumference of the latter in order to continue its cooling. The molten metal is usually brought into contact with the wall of the cylinder by way of a refractory open channel whose end is flush with said wall. The rotating cylinder carries with it in its movement the metal which progressively solidifies on contact with it.

The molten metal must in addition be retained in the top part of the feed channel. This can be done with the aid of a top refractory wall fixed to the channel, as described in U.S. Pat. No. 4,274,471.

PRIOR ART

This document also reveals the utilization of a cooled roller contiguous with the end of said top wall and initiating the solidification of the top skin of the product and limiting the thickness of the latter.

EP 0198669 also discloses the use for this purpose of a roller which is partly immersed in the molten metal and is driven rotationally.

It has however been found that the products obtained by methods of this kind have a surface state of inadequate quality. The surface is granular if the solidification starts solely at the main casting cylinder, and the use of a second roller or cylinder of smaller diameter leads to a scaly surface of the product.

SUMMARY OF THE INVENTION

The present invention seeks to provide, by a method of the type described above, a product which is exempt from these surface defects.

With this aim in mind, the subject of the invention is a method for the continuous casting of thin products, such as sheets or strips, wherein the molten metal is brought into contact with the cooled wall of a rotationally driven main cylinder, the molten metal being in addition retained by a rotationally driven roller whose diameter is smaller than that of the cylinder and which is held at a distance, from the wall of the main cylinder, substantially equal to the thickness of the cast product.

According to the invention, the roller is driven rotationally at a speed such that its linear peripheral speed is higher than that of the cylinder.

In a particular embodiment of the invention, the speed of the roller in excess of that of the main cylinder amounts to 2 to 20%. It is preferably from 6 to 10%.

It has been found that through the application of the invention the surface defects of the product obtained, such as irregularity or flaking, are eliminated or at least greatly reduced.

It has in particular been found that the above-mentioned surface defects could be attributed to poor control of the trajectory of the strip or sheet just downstream of the "neck" between the main cylinder and the roller, the product then tending to lose contact with the main cylinder, whereas it should remain in contact over a certain circumferential distance, starting from said neck, in order to ensure uniformity of contact between the bottom face of the product and the cylinder. The problem to be solved was thus the accurate control of the trajectory of the cast product from the neck onwards, in order to achieve the desired intimate contact with the main cylinder.

It should be understood that the use of a second roller or of a series of rollers intended to guide the product, such as are shown in U.S. Pat. No. 4,274,471 previously mentioned, does not enable this problem to be solved, because even if these rollers are close to one another, there is necessarily a certain distance between the points of contact of the first and second rollers, and over this distance the product cannot be held in perfect contact with the main cylinder.

By means of experiments conducted in the case of the casting of steel in thin strips, it has now been shown that the strip has a natural tendency to become detached from the cylinder wall from the neck onwards, this effect occurring to a greater or lesser extent depending on casting conditions, even if the strip is guided downstream of the neck by appropriate means.

It appears, in fact, that it is essentially the upper skin of the product which tends to remain in contact with the top roller downstream of the neck, with the consequent tendency of the lower skin to become detached from the cylinder.

According to the present invention, the rotational driving of the roller, in the direction opposite to that of the main cylinder and at a higher linear peripheral speed than the latter, makes it possible to achieve the desired substantially perfect contact between the lower face of the product and the wall of the main cylinder.

Preferably, the roller is rotationally driven at a speed such that the ratio of its linear peripheral speed to the linear peripheral speed of said cylinder is in the range of 1.02 to 1.20 and greater than the ratio $$\frac{R+d}{R},$$

where R is the radius of the main cylinder and d is the thickness of the cast product, the effect being that the roller is driven at a linear speed greater than that of the upper skin.

It is recalled that in this type of casting a liquid pool retained between two solidifying skins is formed. A lower skin, whose thickness increases from the point of first contact of the molten metal with the cylinder, is formed on the main cylinder, and an upper skin is formed in the same way on contact with the roller. It is known to attempt to position the bottom of the liquid pool substantially at the neck, in order to avoid, on the one hand, the rolling of the product and the consequent considerable stresses on the cylinder and roller, in the case of a pool bottom upstream of the neck, and on the other hand the risk of breakouts in the case of a pool bottom downstream of the neck.

It has been determined that, when a peripheral speed of the roller exceeds that of the cylinder by less than about 2%, this slight excess speed is insufficient for the tendency of the upper skin to acquire a higher speed than the lower skin to bring the product down against the main cylinder through the action of the mechanical coupling brought about between the two skins at the bottom of the liquid pool.

Inversely, with the same speed of the cylinder and with the same thickness of the product, and although a considerable excess speed could if really necessary be achieved, if this excess speed is higher than about 20% the bottom of the liquid pool may be displaced too far downstream of the neck; this could in particular be due to too fine a skin formed on the top roller. The two skins are then no longer in good contact with one another and tend not to follow a common trajectory.

It will be understood that the relative excess speed of the roller over that of the cylinder does not have the effect of bringing about an equivalent excess speed of the upper skin of the product over that of its lower skin. The roller in fact has a sliding action on the upper skin, thus tending to "push" the upper skin in the direction of the extraction of the product. This sliding tends to increase with rising excess speed, while the pushing action on the upper skin increases simultaneously. However, it is clear that the difference in speed between the top roller and the skin which forms on it does not depend solely on the excess speed, but depends also on other parameters influencing the mechanical "coupling" between the roller and the upper skin of the product, such as the surface state of the roller, its roughness, its cleanliness, and so on.

Another object of the invention is an apparatus for carrying out the above described method. An apparatus for the continuous casting of thin products of this type comprises a rotationally driven main cylinder whose side wall is cooled, a channel feeding molten metal onto said wall of the cylinder, and a cooling roller disposed parallel to the main cylinder at a distance from the latter substantially equal to the desired thickness of the product, this roller at least partially closing the top zone of the end of the feed channel.

According to the invention, the apparatus also comprises means for rotationally driving the roller at a speed adjustable independently of the speed of the main cylinder for the purpose of regulating the linear peripheral speed of the cylinder to a value higher than that of the linear peripheral speed of the main cylinder.

Other advantages and characteristics of the invention will emerge on persual of the description given below by way of example of a method and an apparatus according to the invention.

BRIEF DESCRIPTION OF THE DRAWING

Reference will be made to the accompanying single FIGURE, which shows schematically a plant for the continuous casting of thin steel strips.

DESCRIPTION OF THE PREFERRED EMBODIMENTS

The plant comprises a main cylinder 1 driven rotationally in the direction of the arrow F1 by a motor 2. The speed of rotation may be adjustable in order to permit adaptation to different casting conditions. The cylinder 1 has a side wall 11 cooled in conventional manner, for example, by the internal circulation of a cooling fluid.

A roller 3 is disposed parallel to the cylinder, at a distance from the latter substantially equal to the desired thickness of the metal strip 10. The side wall of said roller is also cooled. The roller 3 is driven rotationally in the direction of the arrow F2 by a motor 4, and its speed can be regulated by the regulating means 5.

The roller 3 is positioned relative to the cylinder 1 in a sector of an angle $\alpha$ between 0° and 45° in relation to the vertical.

A molten metal feed channel 6 of refractory material is disposed next to the cylinder 1. Minimal clearance is provided between the end 61 of said channel and the cylinder wall in order to avoid wear on the latter, while avoiding leakage of molten metal.

Similarly, a top wall 62 of the channel lies next to the roller 3. However, this wall is not necessary if the position of the surface of the molten metal 7 can be controlled so that the latter does not overflow above said roller.

A scraper 8 is disposed near the cylinder 1 at the point where the solidified strip 1 moves away from the cylinder, in order to guide said strip.

As an example, the strip 10 produced in an experimental plant has a thickness of about 1 millimeter. The diameter of the cylinder 1 is 660 millimeters and that of the roller 3 is 200 millimeters. These values are given by way of example, and it is clearly understood that the diameters may be different from the values indicated above. The ratio between the respective diameters of the cylinder and roller may also be modified. In any case, however, the diameter of the roller is preferably smaller than that of the cylinder.

During casting, the cylinder and the roller are driven rotationally. The molten metal 7 is fed into the channel 6 and its level is preferably maintained slightly below the axis of the roller.

The linear peripheral speed of the roller 3 is regulated to be higher than that of the cylinder 1. The difference in speed is preferably of the order of 6 to 10%, but may range from 2 to 20%.

On contact with the cooled walls of the cylinder 1 and of the roller 3, the molten metal 7 solidifies and forms on each of the cooled surfaces a solidified skin, the thickness of which increases in the casting direction. In the example given above, the roller 3 has a diameter smaller than that of the cylinder 1. The side walls both copper walls, of the cylinder and of the roller are both copper walls, and the cooling of these walls is such that the heat exchange conditions on their surfaces are similar. Consequently, and because in the present example the length, as far as the neck, of the arc of contact between the cast metal and the roller 3 is shorter than the corresponding length of contact with the cylinder 1, and because the linear peripheral speed of the roller 3 is higher than that of the cylinder 1, the duration of the contact between the cast metal and the roller wall is shorter than the duration of the contact with the cylinder. As a consequence, the skin 10' formed on the cylinder 1 has a thickness greater than the skin 10'' formed on the roller 3. The two skins 10' and 10'' meet substantially at the neck between the cylinder and the roller.

It should, however, be clearly understood that there is no precise boundary between the skins and the liquid metal, as the metal passes progressively from the liquid state to the solid state by way of a pasty zone. The position of this zone can be adjusted by acting on the speeds of rotation of the cylinder and roller or on the intensity of the cooling of the walls of the cylinder and the roller, the object being to obtain a product solidified over its entire section downstream of the neck.

The apparatus and the method according to the invention make it possible to obtain a product—a sheet or a band—having a good surface state, without the defects referred to previously.

A single drive motor can be used for the cylinder and the roller, with the interposition between them of a speed variator, the casting speed being, for example, adjustable from a few tens to a few hundreds of meters per minute.

The position of the roller relative to the cylinder can also be modified, and the angle may have any value.

Similarly, the excess speed will have to be adapted in dependence on the casting conditions, the respective coolings of the cylinder and roller, the nature and surface state of the cylinder and roller, and also their lubrication, if required.

The method is obviously applicable to the casting of metals other than steel.

I claim:

1. A method for the continuous casting of thin metal products, said method comprising the steps of:

(a) bringing molten metal into contact with a cooled wall of a rotationally driven main cylinder;

(b) retaining said molten metal by a rotationally driven roller whose diameter is smaller than that of said cylinder, and which is positioned at a distance, from said wall of said main cylinder, substantially equal to a desired thickness of a product being cast;

(c) solidifying said metal by cooling onto said wall of said main cylinder and a facing wall of said roller to form upper and lower solidified skins defining between them a liquid pool of metal at a neck formed between said main cylinder and said roller;

(d) regulating the speeds of said main cylinder and of said roller independently of one another so that a bottom of said liquid pool is substantially at said neck between said main cylinder and said roller; and (e) rotationally driving said roller at a speed such that the ratio of its linear peripheral speed to the linear peripheral speed of said cylinder is in the range of 1.02 to 1.20 and greater than the ratio $$\frac{R+d}{R},$$

where R is the radius of the main cylinder and d is the thickness of the cast product, the effect being that said roller is driven at a linear speed greater than that of said upper skin.

2. A method as claimed in claim 1, wherein said linear peripheral speed of said roller is 6 to 10% greater than said peripheral speed of said main cylinder.

* * * * *